US005271825A

United States Patent [19]

Bortz et al.

[11] Patent Number: 5,271,825

[45] Date of Patent: * Dec. 21, 1993

[54] TURBINE OIL PRODUCTION

[75] Inventors: Robert W. Bortz, Woodbury Heights; William E. Garwood, Haddonfield; Quang N. Le, Cherry Hill, all of N.J.; Stephen S. Wong, Singapore, Singapore

[73] Assignee: Mobil Oil Corporation, Fairfax, Va.

[ * ] Notice: The portion of the term of this patent subsequent to Jun. 4, 2008 has been disclaimed.

[21] Appl. No.: 807,003

[22] Filed: Dec. 13, 1991

[51] Int. Cl.[5] ..... C10G 47/00

[52] U.S. Cl. ..... 208/58; 208/87; 208/111; 208/291

[58] Field of Search ..... 208/58

[56] References Cited

U.S. PATENT DOCUMENTS

| | | | |
|---|---|---|---|
| 4,162,962 | 7/1979 | Stangeland | 208/58 |
| 4,347,121 | 8/1982 | Mayer et al. | 208/58 |
| 4,414,097 | 11/1983 | Chester et al. | 208/58 |
| 4,747,932 | 5/1988 | Miller | 208/58 |
| 4,822,476 | 4/1989 | Ziemer et al. | 208/58 |
| 4,913,794 | 4/1990 | Le et al. | 208/18 |
| 4,921,594 | 5/1990 | Miller | 208/58 |
| 5,021,142 | 6/1991 | Bortz et al. | 208/58 |
| 5,037,528 | 8/1991 | Garwood et al. | 208/58 |

*Primary Examiner*—Helane Myers

*Attorney, Agent, or Firm*—Alexander J. McKillop; Malcolm D. Keen; Richard D. Stone

[57] ABSTRACT

Turbine oils are produced from a distillate lube fraction by hydrocracking to remove aromatics, catalytically dewaxing, hydrofinishing then treating with an organic peroxide, such as ditertiary butyl peroxide (DTBP) to increase viscosity and reduce cloud point.

6 Claims, No Drawings

TURBINE OIL PRODUCTION

FIELD OF THE INVENTION

The present invention relates to a process for the production of turbine oils.

BACKGROUND OF THE INVENTION

Mineral oil lubricants including turbine oils are derived from various crude oil stocks by a variety of refining processes. Generally, these refining processes are directed towards obtaining a lubricant base stock of suitable boiling point, viscosity, viscosity index (VI) and other characteristics. Generally, the base stock will be produced from the crude oil by distillation of the crude in atmospheric and vacuum distillation towers, followed by the separation of undesirable aromatic components and finally, by dewaxing and various finishing steps. Because aromatic components lead to high viscosity and extremely poor viscosity indices, as well as poor oxidation stability in the finished product, the use of asphaltic type crudes is not preferred as the yield of acceptable lube stocks will be extremely low after the large quantities of aromatic components contained in such crudes have been separated out; paraffinic and naphthenic crude stocks will therefore be preferred but aromatic separation procedures will still be necessary in order to remove undesirable aromatic components. In the case of the lubricant distillate fractions, generally referred to as the neutrals, e.g., heavy neutral, light neutral, etc., the aromatics will usually be extracted by solvent extraction using a solvent such as furfural, N-methyl-2-pyrrolidone, phenol or another material which is selective for the extraction of the aromatic components. If the lube stock is a residual lube stock, the asphaltenes will first be removed in a propane deasphalting step followed by solvent extraction of residual aromatics to produce a lube generally referred to as bright stock. In either case, however, a dewaxing step is normally necessary in order for the lubricant to have a satisfactorily low pour point and cloud point, so that it will not solidify or precipitate the less soluble paraffinic components under the influence of low temperatures.

A number of dewaxing processes are known in the petroleum refining industry and of these, solvent dewaxing with solvents such as methylethylketone (MEK), a mixture of MEK and toluene or liquid propane, has been the one which has achieved the widest use in the industry.

The catalytic dewaxing process operates by selectively cracking the normal and slightly branched paraffins to produce lower molecular weight products which may then be removed by distillation from the higher boiling lube stock. The catalysts have usually been zeolites which have a pore size which admits the straight chain, waxy n-paraffins either alone or with only slightly branched chain paraffins but which exclude more highly branched materials and cycloaliphatics. Zeolites such as ZSM-5, ZSM-11, ZSM-12, ZSM-22, ZSM-23, ZSM-35, ZSM-38 and the synthetic ferrierites have been proposed for this purpose in dewaxing processes, as described in U.S. Pat. Nos. 3,700,585 (Re 28398); 3,984,938; 3,933,974; 4,176,050; 4,181,598; 4,222,855; 4,259,170; 4,229,282; 4,251,499; 4,343,692, and 4,247,388. A dewaxing process employing synthetic offretite is described in U.S. Pat. No. 4,259,174. Processes of this type have become commercially available as shown by the 1986 Refining Process Handbook, Hydrocarbon Processing, September 1986, which refers to the availability of the Mobil Lube Dewaxing Process (MLDW). Reference is made to these disclosures for a description of various catalytic dewaxing processes.

Although these catalytic dewaxing processes are invariably carried out in the presence of hydrogen, it is not necessary for the stoichiometry of the dewaxing process which, as noted above, proceeds by a shape-selective cracking mechanism. For this reason it is not necessary for the catalyst to include a hydrogenation component although one may be included in order to improve catalyst reactivation. The hydrogen serves to extend catalyst life during each dewaxing cycle. The effluent from the dewaxing reactor includes olefins which have been produced by the cracking reactions and in order to stabilize the product, a hydrotreating step is carried out after the dewaxing to saturate lube boiling range olefins and, depending upon the hydrotreating conditions, to saturate aromatics remaining in the product stream as well as to remove heteroatom impurities, principally sulfur and nitrogen and various color bodies. A process for hydrotreating a catalytically dewaxed lube product is described in U.S. Pat. No. 4,181,598.

Turbine oils are a special class of lubricants which require exceptional oxidation stability over extended periods of time.

The exceptionally stringent product specifications associated with turbine oils are necessary because of the severe conditions associated with their use. Turbine oils are expected to last the life of the turbine. This involves years of continuous operation at moderately elevated temperature, and in the presence of air, water and metals. The conditions are not at all like those in an automobile. Good survey articles on the special problems of turbine oils are presented in:

1. Control of Turbine Oil Degradation During Use, M. J. Den Herder and P. C. Vienna, Lubrications Engineering, 37 (2), February 1981, and 2. Evaluation and Performance of Turbine Oils, G. H. von Fuchs et al, Industrial and Engineering Chemistry, Vol. 13, No. 15, both of which are incorporated by reference.

An additional indication of the severe uses to which turbine oils are put may be taken from the following standardized test methods used to define good turbine oil properties.

TOST TEST

The Turbine Oil Stability Test (TOST) modified ASTMD 943 determines the oxidation stability of steam-turbine oils. Briefly, 300 ml of the oil sample is subjected to a temperature of 95° C. in the presence of 60 ml of water, oxygen at a flow rate of 3 liters per hour (plus or minus ½ liter per hour) and an iron-copper catalyst.

The TOST test is a long term measure of the oxidation stability of the oil. A somewhat related test is JISK 2515; testing method for oxidation characteristics of turbine oils. In this test oxygen is blown into a sample at 95° C. in the presence of steel wire, copper wire and water to observe surface changes in the metals and state of water and oil phases. More details about this and related test methods are contained in U.S. Pat. Nos. 4,247,414 and 4,247,415 which are incorporated herein by reference.

RBOT TEST

The rotary bomb oxidation test (RBOT) is a relatively short term test method for the oxidation stability of lubricating oils.

The RBOT test is a rapid means of estimating the oxidation stability of new turbine oils. In the test, the turbine oil sample, water and a copper catalyst coil are placed in a covered glass container, and placed in a bomb equipped with a pressure gauge. The bomb is charged with oxygen to a pressure of 90 psi (620 kpa) and placed in a constant temperature oil bath maintained at 150° C. and rotated at 100 rpm. The pressure in the bomb is monitored continuously. At first the pressure increases sharply, typically to about 190–200 psi, because of the increase in temperature. The pressure remains relatively stable, until the oil breaks down. The bomb life of the sample is the time in minutes from the start of the test to a 25 psi pressure drop from the established plateau pressure. Usually the test uses a 3 m length of 14 Awg of copper wire which has been cleaned (preferably in sodium cyanide).

In general terms the required properties of turbine oils are as follows:

| | |
|---|---|
| Boiling range = | 650–1100° F. |
| Viscosity = | 150–500 SUS at 100° F. |
| Pour Point = | +20° F. or less |
| Cloud Point = | Preferably no more than 10° F. above pour point |
| Aromatics = | less than 5 wt. % |
| Sulfur = | less than 10 ppm |
| Nitrogen = | less than 2 ppm |

The viscosity limit set forth above is not a real upper limit. Viscosities higher than this are not normally required for land based turbines, but could find other applications.

In contrast, passenger car motor oils will have typical aromatic levels of 20–30 wt. %, sulfur contents of 0.5–1 wt. % and nitrogen contents of 40–60 ppm. With these motor oils specifications as a background, the unusual processing steps needed to meet turbine oil specifications will now be reviewed.

Turbine oils must contain very low levels of aromatic components and conventionally are produced by a refining process which includes a severe solvent extraction with a final hydrotreating or hydrofinishing step to reduce the aromatic content to a low level. In order to maximize aromatic saturation the hydrotreating is carried out at high pressure, typically at pressures above 1500 psig (about 10445 kPa abs), usually at 2000–2500 psig (about 13890–17340 kPa abs), over a catalyst comprising a hydrogenation function on a non-acidic support. Following the hydrotreatment, residual aromatic content is usually below about 5 weight percent of the lubricant.

One problem which arises with the hydrotreating is that the viscosity of the oil is reduced to a significant extent. This is not unexpected because the relatively viscous aromatics are converted to less viscous naphthenes as a result of the hydrogenation. This viscosity loss means that the more viscous turbine oils have to be produced by distilling deeper into the vacuum residuum i.e., by increasing the end point of the highest boiling distillate fraction. Because this necessitates significant changes in standard operating procedures it is desirably to be avoided. It also implies that the fractions which are of light neutral quality upon vacuum fractionation e.g. 100 SUS at 40° C., are somewhat below target viscosity at the end of the refining process and therefore cannot be used as turbine oils. It would therefore be desirable to control the viscosity of the hydrotreated turbine oil product.

Another problem encountered in producing a satisfactory turbine oil is achieving a product which meets both the pour point specification and the cloud point specification. Catalytic dewaxing reduces the pour point, but the cloud point may be too high after catalytic dewaxing.

It may be possible to reduce cloud point by resorting to various additive materials, but use of such additives increases the cost of the turbine oils, and adds some uncertainties about their long term stability.

Accordingly it can be seen that the all catalytic route to turbine oils presents unique problems. Both hydrocracking, and severe hydrotreating, cause loss in viscosity. Catalytic hydrodewaxing to meet pour point causes cloud point problems. There is a need in the industry to develop a more efficient process for producing turbine oils in good yields, with high enough viscosity, and with a satisfactory cloud point.

Solvent dewaxing produces a product which is satisfactory both as to pour point and as to cloud point, but solvent dewaxing is expensive and the yields are not as high as desired.

Catalytic hydrodewaxing is the preferred method of wax removal for turbine oils, and a good many other oils, but the need to make a satisfactorily low cloud point forces the process to be run at a higher severity than would be required to make a suitable pour point material.

Finally, the high pressure hydrotreating associated with modern turbine oil production methods results in a significant loss in viscosity of the hydrotreated turbine oil product, so a away is needed to overcome this deficiency as well.

A good method of producing turbine oil was disclosed in our prior patent, U.S. Pat. No. 5,021,142, R. W. Bortz et al, which issued in June 1991. Briefly, the patent claimed a process for producing a turbine oil of controlled viscosity, viscosity index and fluidity characteristics by subjecting a distillate lubricating oil fraction to solvent extraction to remove aromatic components, to dewaxing by a solvent or catalytic dewaxing process or both, hydrotreating the dewaxed product to saturate residual aromatics and remove heteroatom-containing impurities and by treatment with an organic peroxide to control the viscosity of the hydrotreated product.

We have now discovered a somewhat related method of producing turbine oil, an all catalytic route which avoids all or most of the costly aromatic extraction step required in our earlier work.

DETAILED DESCRIPTION

The present turbine oil refining process is generally applicable to the production of low pour point turbine oil products from lube range hydrocarbon feeds. As such, the feed will generally have an initial boiling point of at least 650° F. (about 345° C.) in order to prevent excessive volatilities during use. Generally, the end point of the feed will be in the range of 750° F. (about 400° C.) to about 1050° F. (about 565° C.) since distillate (neutral quality) stocks are generally necessary for turbine oil production because of their low aromatic content. The end point of the feed is not in itself significant although the presence of large amounts of high boiling, unextracted residual type material will generally be undesirable because of their effect on the final lubricant properties and because of yield losses which ensue from their removal during refining.

The present process may be used with neutral lube feeds ranging from light neutrals, e.g., from 100 SUS at 100° F. to heavy neutrals, e.g., 700 SUS at 100° F. Typical light to medium neutral stocks may have an IBP below 650° F. (about 345° C.) (ASTM D-2887) and the end point may be below 1000° F. (about 540° C.). Heavier neutrals will generally boil in the range 650° C.-1050° F. (about 345°-565° C., ASTM D-1160, 10 mm. Hg), typically from 750° to 1050° F. (about 400°-565° C., ASTM D-1160).

The selected distillate fraction is subjected to hydrocracking to remove most, and preferably essentially all, undesirable aromatic components. Hydrocracking of lube stocks is well established in the petroleum refining industry. Any conventional lube hydrocracking process can be used. By "essentially all" aromatic species, we mean that sufficient aromatics are removed to result in a product having an aromatic content within the maximum permitted by the turbine oil product specification, generally 5.0 wt % aromatics, maximum.

In some instances it may be desirable to combine hydrocracking with some conventional aromatics extraction technology, such as furfural extraction, but usually it will be preferred to eliminate the aromatics extraction step.

Conventional lube hydrocracking technology may be used. U.S. Pat. Nos. 4,283,271 and '272 disclose a process for the manufacture of hydrocracked low pour lubricating oils. These patents are incorporated herein by reference.

U.S. Pat. No. 4,921,594 (Miller) discloses hydrocracking a heavy feed over nickel tungsten on silica/alumina then catalytic dewaxing.

U.S. Pat. No. 4,897,178 (Best) discloses lube hydrocracking using a zeolite catalyst with a hydrogenation component.

A severe hydrotreating process for manufacturing lube oils is disclosed in *Developments in Lubrication* PD 19(2), 221-228, S. Bull et al. Waxy feeds such as waxy distillates, deasphalted oils and slack waxes are subjected to a two-stage hydroprocessing operation in which an initial hydrotreating unit processes the feeds in blocked operation with the first stage operating under higher temperature conditions to remove undesirable aromatic compounds by hydrocracking and hydrogenation. The second stage operates under milder conditions of reduced temperature at which hydrogenation predominates, to adjust the total aromatic content.

Hydrocracking over an amorphous bifunctional catalyst such as nickel-tungsten on alumina or silica-alumina are disclosed, for example, in British Patents Nos. 1,429,494, 1,429,291 and 1,493,620 and U.S. Pat. Nos. 3,830,273, 3,776,839, 3,794,580, and 3,682,813.

The hydrocracking catalyst is a bifunctional catalyst which comprises a a zeolite or amorphous material which acts as a support and in addition, provides the desired acidic functionality for the hydrocracking reactions, together with a hydrogenation-dehydrogenation component. The hydrogenation-dehydrogenation component is provided by a metal or combination of metals. Noble metals of Group VIIIA, especially platinum, or base metals of Groups IVA, VIA and VIIIA, especially chromium, molybdenum, tungsten, cobalt and nickel, may be used. Base metal combinations such as nickel-molybdenum, cobalt-nickel, nickel-tungsten, cobalt-nickel-molybdenum and nickel-tungsten-titanium are useful.

The content of the metal component will vary according to its catalytic activity. Thus, the highly active noble metals may be used in smaller amounts than the less active base metals. For example, about 1 wt. percent or less platinum will be effective and in a preferred base metal combination, about 7 wt. percent nickel and about 2.1 to about 40 wt. percent tungsten, expressed as metal. The hydrogenation component can be exchanged onto the support material, impregnated into it or physically admixed with it.

Conventional hydrocracking conditions may be used. The feedstock is heated to an elevated temperature and is then passed over the hydrocracking catalysts in the presence of hydrogen. The objective of the process is primarily to saturate aromatics and to carry out hydrocracking of the oil and waxes, with isomerization of the waxes to lower pour point iso-paraffins. Because the thermodynamics of hydrocracking become unfavorable at temperatures above about 450° C. (about 850° F.) temperatures above this value will not normally be used. In addition, because hydrocracking is exothermic, the feedstock need not be heated to the temperature desired in the catalyst bed which is normally in the range 290°, usually 360° C. to 440° C. (about 550°, usually 675° F. to 825° F.). At the beginning of the process cycle, the temperature employed will be at the lower end of this range but as the catalyst ages, the temperature may be increased to maintain the desired degree of activity.

The feedstock is passed over the catalysts in the presence of hydrogen. The space velocity of the oil is usually in the range 0.1 to 10 LHSV, preferably 0.2 to 2.0 LHSV and the hydrogen circulation rate from 250 to 1,500 $n.1.1^{-1}$. (about 1400 to 8,427 SCF/bbl) and more usually from 300 to 800 (about 1685 to 4500 SCF/bbl). Hydrogen partial pressure is usually at least 75 percent of the total system pressure with reactor inlet pressures normally being in the range of 3000 to 30,000 kPa (about 420 to about 4,335 psig). High pressure operation is normally preferred in order to saturate aromatics. Pressures will therefore usually be at least about 7,000 kPa (about 1000 psig) and often above about 15,000 kPa (about 2160 psig), most often in the range of about 10,000 to 18,000 kPa (about 1435 to 2600 psig). Conversion to products boiling outside the lube range, typically to 345° C.-(about 650° F.-) products, is normally from about 5 to 70 volume percent, more usually from 10 to 40 volume percent, depending on the feed and the target VI for the product.

Following the hydrocracking, the hydrocrackate is catalytically dewaxed to improve its fluidity properties, especially its pour point, freeze point and cloud point. Dewaxing processes of this kind are well known. See Industrial Application of Shape-Selective Catalysis, Chen and Garwood Catal. Rev. - Sci. Eng. 28 (2-3), 185-264 (1986), especially 244-247, to Which reference is made for a description of the preferred lube dewaxing process using a ZSM-5 dewaxing catalyst.

As described in the Chen and Garwood article, the shape-selective dewaxing over the intermediate pore size zeolite is followed by a hydrotreating step to ensure that the lube meets quality and performance specifications. See also Oil Gas Journal 78 (21), 75 (1980) and U.S. Pat. Nos. 4,181,598 and 4,137,148. The hydrotreating or hydrofinishing step saturates olefins in the lube boiling range and, under high hydrogen pressures, also saturates residual aromatics which have not been removed during the hydrocracking. To achieve this, relatively high hydrogen pressures usually at least 1500 psig (about 10,445 kPa) are necessary. The catalyst will typically include a base metal hydrogenation component on a relatively non-acidic porous oxide support such as alumina, silica or silica-alumina. The use of noble metals such as platinum is not excluded except mainly on the grounds of cost and a mild degree of acidity or the support may be desirable to promote ring opening reactions. Base metals of Groups VIA an VIIIA (IUPAC Table) such as nickel, cobalt, molybdenum and vanadium are preferred especially in combinations such as nickel-molybdenum, cobalt-molybdenum. The amount of the metal component is typically up to 20 weight percent of the catalyst, usually 5-20 weight percent. Hydrotreating temperatures are typically about 500° to 800° F. (about 260° to 425° C.), usually 600° to 750° F. (about 315° to 400° C.), with space velocities of 0.1-5, usually 0.1-2 $hr^{-1}$ LHSV.

Peroxide Treatment

The dewaxed product is subjected to treatment with an organic peroxide compound at elevated temperature in order to affect a coupling between the paraffinic components (paraffin molecules and alkyl side chains on ring compounds) to increase the viscosity of the lubricant, and also to overcome a cloud problem created, or left unresolved, by catalytic dewaxing.

The preferred class of peroxides which are used are the ditertiary alkyl peroxides represented by the formula $ROOR^1$ where R & $R^1$ are the same or different tertiary alkyl radicals, preferably lower ($C_4$ to $C_6$) tertiary alkyl radicals. Suitable peroxides of this kind include ditertiary butyl peroxide, ditertiary amyl peroxide and tertiary butyl, tertiary amyl peroxide. Other organic peroxides may also be used including dialkyl peroxides with one to ten carbon atoms such as dimethyl peroxide, diethyl peroxide, dipropyl peroxide, di-n-butyl peroxide, dihexyl peroxide and acetylperoxides such as dibenzoylperoxide.

The amount of peroxy compound used in the process is determined by the increase in viscosity which is desired in the treatment. In general, the increase in viscosity is related to the amount of peroxide used with greater increases resulting from greater amounts of peroxide. As a general guide, the amount of peroxide catalyst employed will be from 1 to 50, preferably from 4 to 30 weight percent of the oil. There is essentially an exponential relationship between the proportion of peroxide used and the viscosity increase, both with batch and continuous reaction. The presence of hydrogen may decrease peroxide utilization slightly but significant increases in viscosity may still be obtained without other lube properties (pour point, V.I.) being significantly affected. It would therefore be practicable to cascade the effluent from a catalytic hydrodewaxing-/hydrotreating unit directly to a peroxide treatment reactor, permitting the hydrogen to remain in the stream. The coupling of paraffinic components out of the lube boiling range would, in this case, increase lube yield and for this reason may represent a preferred process configuration.

The reaction between the lubricant component and the peroxide is carried out at elevated temperature, suitably at temperatures from about 50° C. to about 300° C. and in most cases from 100° C. to about 200° C. The treatment duration will normally be from about 1 hour to 6 hours but there is no fixed duration since various starting materials will vary in their reactivity and amenability to coupling by this method. The pressure employed will depend upon the temperature used and upon the reactants and, in most cases, needs to be sufficient only to maintain the reactants in the liquid phase during the course of the reaction. Space velocity in continuous operation will normally be from 0.25 to 5.0 LHSV ($hr^{-1}$).

The peroxide is converted during the reaction primarily to an alcohol whose boiling point will depend upon the identity of the selected peroxide. This alcohol by-product may be removed during the course of the reaction by simple choice of temperature and pressure and accordingly temperature and pressure may be selected together to ensure removal of this by product. The alcohol may be converted back to the peroxide in an external regeneration step and recycled for further use. If ditertiary butyl peroxide is used, the tertiary butyl alcohol formed may be used directly as a gasoline octane improver or, alternatively, it may be readily converted back to the original di-tertiary butyl peroxide by reaction with butyl hydro-peroxide in the presence of a mineral acid, as described in U.S. Pat. No. 2,862,973, with the butyl hydroperoxide being obtained by the direct oxidation of isobutane, as described in U.S. Pat. No. 2,862,973.

The reaction may be carried out batchwise or continuously and in either case it is preferable to inject the peroxide compound incrementally so as to avoid exotherms and the production of lower quality products associated with high reaction temperatures. If the reaction is carried out in a continuous tubular reactor it is preferred to inject the peroxide compound at a number of points along the reactor to achieve the desired incremental addition.

The effect of the peroxide treatment is principally to increase the viscosity of the lubricant without affecting a significant reduction in viscosity index or significant increases in pour point or cloud point. For reasons which are not entirely understood, the peroxide treatment also reduces cloud point.

The increase in viscosity implies an increase in molecular weight while the relatively constant pour point suggests that the reaction products are isoparaffinic in nature. It is thought that the action of the peroxide is by the removal of hydrogen atoms to form free radicals in non-terminal positions which then combine with each other to form branched chain dimers which are capable of reacting even more rapidly than the monomer. Thus, the viscosity of the treated material increases rapidly in the presence of additional amount of peroxide which generate new free radicals. The greater reactivity perceived with the initial dimer may be attributed to reactive tertiary hydrogens which are present in the dimers and higher reaction products but not on the paraffins present in the starting material. The greater reactivity of the dimers indicates that the incremental addition of successively smaller amounts of peroxide, particularly in continuous tubular reactor synthesis, will produce relatively greater progressive increases in viscosity and will also ensure that the range of molecular weights in the product will be narrower and that product quality will be more consistent.

The coupled products may include very small amounts of olefins and in order to improve the stability of the final lube products, the peroxide-treated products may be subjected to mild hydrotreating to saturate any lube range olefins. Treatment over a conventional hydrotreating catalyst such as Co/Mo on alumina at mild temperatures typically to 500° F. (260° C.) at relatively low hydrogen pressures, typically up to 1000 psig (7000 kPa) will normally be satisfactory. At low hydrotreat temperature up to about 550° F. (290° C.) viscosity loss on hydrotreating is minimal although greater losses may be observed at higher temperatures. Pour point and V.I. remain relatively constant with temperature.

Because the peroxide treatment increases the molecular weight of the hydrocarbons by a coupling reaction resulting mostly in the production of dimers with some trimer and higher reaction products, the boiling point of the product increases commensurately with the extent of the coupling reaction. It is therefore possible to employ a non-lube fraction as the feed for the peroxide treatment step i.e. a feed boiling below the lube boiling range, for example, a 600° F.- (about 315° C.-) fraction, especially the middle distillate boiling in the range of about 330°-650° F. (about 165°-345° C.). Fractions boiling below about 330° F. (about 165° C.) will normally not be preferred because excessive peroxide consumption is necessary to bring these naphtha range materials into the lube boiling range.

The peroxide treatment may be carried out before or after the hydrotreatment. Because the effluent from a catalytic dewaxing step may be cascaded directly to the hydrotreating step and from there to the peroxide treatment, this may represent an attractive processing scheme. Conversely, the use of a hydrotreatment step after the peroxide treatment may be desirable to remove residual unsaturation, as described above, and to reduce product bromine numbers to zero or to very low levels e.g. below 1.0.

Very low pour point turbine oils may be produced by a second dewaxing step after the peroxide treatment (and after any subsequent hydrotreatment). The pour point of such products will typically be below −10° F. (−23° C.) and may be at least as low as −40° F. (−40° C.), comparable to those of synthetic lubricants.

The following examples do not illustrate the claimed invention, per se. They are taken from our earlier patent, U.S. Pat. No. 5,021,142. They show the beneficial effect of peroxide treatment in solving cloud point problems of a lube fraction made by furfural extraction, catalytic dewaxing, and peroxide treatment.

EXAMPLE 1

This example illustrates the effects of solvent extraction, solvent dewaxing and hydrotreating on a neutral lube fraction.

The vacuum distillate was obtained from Arab Light Crude amounting to 6.6 volume percent of the crude and had the properties set out in Table 1 below:

TABLE 1

| Arab Light Neutral | |
|---|---|
| Gravity, °API | 22.0 |
| Gravity, Specific | 0.9218 |
| Pour Point, °F. (°C.) | +90 (32) |
| K.V. @ 100° C., cs | 8.88 |
| Sulfur, wt. % | 2.22 |
| Distillation, °F. (D-1160) | |
| 1% | 705 |
| 5% | 774 |
| 10% | 789 |
| 30% | 823 |
| 50% | 856 |
| 70% | 902 |
| 90% | 949 |
| 95% | 965 |

The distillate was extracted with furfural (conditions: 245% dosage, 120°/107°/100° C. Top/Feed/Bottoms temperatures) and then solvent dewaxed (conditions: 65/35 MEK/Toluene solvent, 160% dilution, 150% washing at a filtration temperature of −16° C.) to give a 37.3 vol. % yield of dewaxed oil based on raw distillate. The dewaxed oil was then hydrotreated over a $Co/Mo/Al_2O_3$ catalyst at 2000 psig, 0.3 LHSV, 670° F., yield 94.5 vol. pct. (13890 kPa abs., 0.3 $hr^{-1}$ LHSV, .354° C., 94.5 vol. pct).

TABLE 2

| | Dewaxed AL Neutral | |
|---|---|---|
| | Before Hydrotreating | After Hydrotreating |
| Gravity, °API | 30.0 | 34.0 |
| Gravity, Specific | 0.8702 | 0.8550 |
| Pour Point | +10 (−12) | +15 (−9) |
| Sulfur, wt. % | 0.60 | less than 0.01 |
| Nitrogen, ppm | 52 | 3 |
| Aromatics, wt. % | 25.9 | 4.4 |
| K.V. @ 40° C., cs | 54.02 | 32.04 |
| K.V. @ 100° C., cs | 7.61 | 5.71 |
| SUS @ 100° F. (38° C.) | 279 | 165 |
| SUS @ 210° F. (99° C.) | 51.7 | 45.4 |
| Viscosity Index | 103.4 | 119.8 |

Hydrotreating removed essentially all the sulfur and nitrogen and saturated most of the aromatics, resulting in a much lower viscosity but also higher viscosity index.

EXAMPLE 2

This Example illustrates the effect of peroxide treatment on the hydrotreated oil.

In each run of this Example, 100 g of the hydrotreated stock from Example 1 was placed in a 500 ml round bottom flask equipped with a stirrer, thermometer, water condenser, condenser liquid take-off and dropping burette. The flask was heated to 150° C., and the DTBP added dropwise from the burette over a one hour period. The temperature was held at 150° C. for a one hour period. The temperature was held at 150° C. for an additional three hours, then raised to about 185° C. in the next two hours. The contents were then cooled to room temperature and topped, first at atmospheric pressure to a pot temperature of 190° C. to remove any DTBP decomposition products not condensed in the take-off during the reaction period.

Three quantities of DTBP were used with results as set out in Table 3.

TABLE 3

| | DTBP Treatment of Hydrotreated Oil | | | |
|---|---|---|---|---|
| Run No. | Charge | 2-1 | 2-2 | 2-3 |
| Stock, g | | 100 | 100 | 100 |
| DTBP, g | | 5 | 10 | 20 |
| Lube Yield, Wt. % | | 98.6 | 98.5 | 98.8 |
| Lube Properties | | | | |
| Gravity, °API | 34.0 | 33.1 | 32.6 | 31.5 |
| Specific | 0.8550 | 0.8597 | 0.8623 | 0.8681 |
| Pour Point, | +15 (−9) | +15 (−9) | +10 (−12) | +10 (−12) |

TABLE 3-continued

| DTBP Treatment of Hydrotreated Oil | | | | |
|---|---|---|---|---|
| Run No. | Charge | 2-1 | 2-2 | 2-3 |
| °F. (°C.) | | | | |
| K.V. @ 40° C., cs | 32.04 | 45.50 | 59.24 | 93.54 |
| K.V. @ 100° C., cs | 5.71 | 7.20 | 8.66 | 11.88 |
| SUS | | | | |
| @ 100° F. (38° C.) | 165 | 234 | 305 | 484 |
| @ 210° F. (99° C.) | 45.4 | 50.3 | 55.4 | 107.2 |
| Vis. Index | 119.8 | 118.8 | 120.0 | 117.9 |

The data show an increase in viscosity with essentially no change in pour point or viscosity indices. They also show that reaction with about 5% DTBP restores the viscosity to that of the dewaxed stock before hydrotreating.

EXAMPLE 3

This Example illustrates the effect of progressive addition of the peroxide compound.

In this Example, 50 g of the product from Run No. 2-2 of Example 2 was reacted with 5 g DTBP, effecting a second pass operation for comparison with Run 2-3 which used the same overall wt. % of DTBP in a single pass operation. Results compare as shown in Table 4.

TABLE 4

| Multi-Pass DTBP Treatment | | | |
|---|---|---|---|
| Run No. | | 2-3 | 3-1 |
| Type | Charge | One-Pass | Two-Pass |
| Gravity. | | | |
| °API | 34.0 | 31.5 | 30.7 |
| Specific | 0.8550 | 0.8681 | 0.8724 |
| Pour Point, °F. (°C.) | +15 (−9) | +10 (−12) | +10 (−12) |
| K.V. @ 40° C., cs | 32.04 | 93.54 | 114.4 |
| K.V. @ 100° C., cs | 5.71 | 11.88 | 13.94 |
| SUS @ 100° F. (38° C.) | 165 | 484 | 593 |
| SUS @ 210° F. (99° C.) | 45.4 | 67.2 | 75.3 |
| Vis. Index | 119.8 | 117.9 | 121.3 |

The two pass operation is thus more effective for increasing viscosity than the single pass.

EXAMPLE 4

This Example illustrates the effect of peroxide treatment before hydrofinishing.

The oil feed was the dewaxed Arab Light neutral of Example 1 before hydrotreating (Table 2—before hydrotreating).

The oil (100 g) was reacted with DTBP (10 g) as described in Example 2, with the results set out in Table 5.

TABLE 5

| DTBP Treatment of Dewaxed AL Neutral | | |
|---|---|---|
| | Charge | Product |
| Yield, wt. % | — | 99.5 |
| Gravity, °API | 30.0 | 28.5 |
| Specific | 0.8702 | 0.8844 |
| Pour Point, °F. (°C.) | +10 (−12) | +10 (−12) |
| K.V. @ 40° C., cs | 54.02 | 110.5 |
| K.V. @ 100° C., cs | 7.606 | 12.48 |
| SUS @ 100° F. (38° C.) | 279 | 576 |
| SUS @ 210° F. (99° C.) | 51.7 | 69.5 |
| Vis. Index | 103.4 | 104.5 |

The results show that the hydrotreat step, removing essentially all the sulfur and nitrogen and saturating most of the aromatics, is necessary for the DTBP to be effective in increasing viscosity with no loss of V.I. or pour point. Thus the DTBP step can be used either after or before the hydrotreat step.

EXAMPLE 5

This example shows that the process of the present invention may be used to overcome the cloud point problem encountered with catalytically dewaxed oils.

The feed for these experiments was a catalytically dewaxed light neutral 318 stock having a +24° F. cloud point. This material had been solvent extracted (to remove aromatics) then catalytically dewaxed over ZSM-5.

Typical properties of a solvent dewaxed stock, at a 10° F. pour point, are a 17° F. cloud point, a viscosity of 34.8 CST at 40° C., 5.78 CST at 100° C., 180 SUS at 100° F., and a 107 VI.

The catalytically dewaxed stocks, used in the experiment reported below, are preferred because catalytic dewaxing is much more energy deficient than solvent dewaxing. The catalytically dewaxed material has a higher cloud point than desired (24° F.) and a somewhat lower viscosity index (95) as compared to solvent dewaxed stocks. As reported in the following table, the peroxide treatment of the present invention eliminates the cloud point problem, increases the viscosity of the oil being treated, and brings about some improvement in viscosity index. For comparison purposes, the properties of a typical bright stock, BS 345, are also presented in Table 6.

TABLE 6

| Bright Stock Production From Light Neutral Using Free Radical Chemistry | | | | |
|---|---|---|---|---|
| | FEED | INVENTION | | TYPICAL BS 345 |
| DTBP, wt. % | 0 | 10 | 20 | — |
| Lube Properties | | | | |
| Pour Point, °F. | 10 | 5 | 0 | 20 |
| Cloud Point, °F. | 24 | 10 | −6 | 36 |
| KV @ | | | | |
| 40° C., cSt | 41.64 | 95.31 | 441.4 | 512.8 |
| 100° C., cSt | 6.218 | 10.88 | 31.42 | 32.60 |
| SUS @ 100° F. | 215 | 497 | 2354 | 2755 |
| VI | 95 | 98 | 102 | 95 |
| Flash point COC, F. | 439 | — | 460 | — |
| Bromine No. | 1.0 | — | 1.9 | — |

Table 6 shows that the peroxide treatment of the invention allows production of a lube stock from a light neutral with a viscosity approaching that of bright stock. The peroxide treatment also drastically reduces the cloud point, both in absolute terms and relative to the pour point.

The 30° F. drop in cloud point, resulting in a cloud point below the pour point, was unexpected.

The above examples used extraction, rather than hydrocracking, to remove aromatics. Removal of aromatics by hydrocracking is similar to furfural extraction of aromatics. The process of the present invention thus provides an all catalytic route to the manufacture of turbine oils.

What we claim is:

1. A method of making a turbine oil boiling within the range of 650°-1100° F. and having a viscosity above 150 SUS at 100° F., a pour point of 20° F. or less and a cloud point of 30° F. or less, less than 5.0 wt. % aromatics, a sulfur content of less than 10 ppm and a basic nitrogen content of less than 2 ppm comprising the steps of:

hydrocracking a distillate lubricant fraction at hydrocracking conditions to remove or saturate aromatic components and produce a hydrocrackate having a viscosity and a reduced aromatic content;

catalytically dewaxing the hydrocrackate to produce an intermediate product having a pour point below 20° F. and a cloud point more than 10° F. above the pour point,;

hydrotreating the dewaxed hydrocrackate to hydrogenate unsaturated components, reduce the aromatics content to less than 5.0 wt. % and reduce the viscosity relative to said hydrocrackate; and peroxide treating the dewaxed hydrocrackate fraction with an organic peroxide compound to increase the viscosity of the dewaxed fraction and to reduce the cloud point to within 10° F. of the pour point.

2. The method of claim 1 wherein hydrotreating occurs before peroxide treatment.

3. The method of claim 1 wherein hydrotreating occurs after peroxide treatment.

4. The method of claim 1 wherein the peroxide is ditertiary butyl peroxide in an amount of from 1 to 50 weight percent of the oil being treated, and wherein the peroxide treatment occurs at a temperature from 100° to 300° C.

5. The method of claim 1 wherein the cloud point is reduced to within 5° F. of the pour point.

6. The method of claim 1 wherein the cloud point is below the pour point.

* * * * *